US005525864A

United States Patent [19]

Butler et al.

[11] Patent Number: 5,525,864

[45] Date of Patent: Jun. 11, 1996

[54] RF SOURCE INCLUDING SLOW WAVE TUBE WITH LATERAL OUTLET PORTS

[75] Inventors: Jennifer M. Butler, Pacific Palisades; Robert L. Eisenhart, Woodland Hills, both of Calif.

[73] Assignee: Hughes Aircraft Company, Los Angeles, Calif.

[21] Appl. No.: 194,999

[22] Filed: Feb. 7, 1994

[51] Int. Cl.[6] ..... H01J 23/24; H01J 25/36; H01P 1/16

[52] U.S. Cl. ..... 315/3.6; 315/39; 315/39.3; 331/82; 333/21 R

[58] Field of Search ..... 315/3.5, 3.6, 39.3, 315/39; 331/82; 330/43; 333/21 R

[56] References Cited

U.S. PATENT DOCUMENTS

| | | | |
|---|---|---|---|
| 2,235,527 | 3/1941 | McArthur | 315/3.5 X |
| 2,719,271 | 9/1955 | Preston | 333/21 R |
| 2,721,953 | 10/1955 | Rothstein | 315/3.5 |
| 2,726,291 | 12/1955 | Quate | 315/39.3 X |
| 2,800,632 | 7/1957 | Walker | 333/21 R |
| 3,037,168 | 5/1962 | Forrer | 315/3.6 X |
| 3,080,523 | 3/1963 | Miller | 315/3.5 X |
| 3,259,786 | 7/1966 | Phillips | 315/3.5 X |
| 3,293,482 | 12/1966 | Wolkstein | 330/43 X |
| 3,325,751 | 6/1967 | Phillips | 333/21 R |
| 4,263,566 | 4/1981 | Guenard | 315/3.5 X |
| 4,388,555 | 6/1983 | Symon et al. | 315/4 |
| 4,912,367 | 3/1990 | Schumacher et al. | 315/3.5 |
| 5,015,914 | 5/1991 | Jues et al. | 331/91 X |

FOREIGN PATENT DOCUMENTS

| | | | |
|---|---|---|---|
| 378141 | 1/1974 | U.S.S.R. | 315/39.3 |

OTHER PUBLICATIONS

Jennifer M. Butler, "Experimental Investigation Of Twin Traveling Wave Tube Amplifiers Driven By a Single Relativistic Backward Wave Oscillator", A Dissertation Presented to the Faculty of the Graduate School of Cornell University, Jan. 1991.

R. B. Miller, *Introduction to the Physics of Intense Charged Particle Beams,* Plenum Press, New York, 1985, pp. 31–76.

M. Fazio et al., "Narrow–Band Microwave Generation from an Oscillating Virtual Cathode in a Resonant Cavity", *J. Appl. Phys.*, vol. 65, 1989, p. 1321.

J. Swegle, et al., *Phys. Fluids*, 28(9), Sep. 1985, pp. 2882–2894.

W. W. Destler et al., "Microwave and Particle Beam Sources and Propagation", *SPIE*, vol. 873, (1988), pp. 84–91.

J. Hansen, "US TWTS from 1 to 100 GHz", *Microwave Journal: 1989 State of the Art Ref.* (1989, pp. 179–193).

(List continued on next page.)

*Primary Examiner*—Benny T. Lee

*Attorney, Agent, or Firm*—V. D. Duraiswamy; W. K. Denson-Low

[57] ABSTRACT

Multiple radio frequency (RF) outlet ports are provided along the side of a slow wave tube to establish a distributed RF output in response to the transmission of an $e^-$beam through the tube. The tube has a periodically rippled inner surface, and the outlet ports are spaced along the tube by substantially integral numbers of ripple periods. When implemented as a backward wave oscillator, RF power is extracted during a single pass through the tube; a travelling wave tube amplifier implementation is also possible. The separation of the RF extraction from the absorption of the $e^-$beam at the end of the tube eliminates RF reflections and permits water cooling of the $e^-$beam absorber. The RF extraction ports are also preferably configured as built-in mode converters from a $TM_{01}$ cylindrical tube mode to a $TE_{10}$ rectangular extraction mode, with four symmetrically arranged rectangular extraction waveguides at each extraction location combining their energies into a single $TE_{10}$ output. Reductions in the cylindrical tube diameter after each extraction location reflect radiation back through the tube to cancel back-scattered radiation losses from the extraction ports.

23 Claims, 5 Drawing Sheets

OTHER PUBLICATIONS

Phelps, "More Than 10 GW from a Relativistic BWO?", *Third National Conference on High Power Microwaves Digest*, Dec. 1986, pp. 240–244.

Voss, et al., "Characterization of a High Power Microwave Cross–Field Oscillator Operated at S–Band," *Third National Conference on High Power Microwaves Digest*, Dec. 1986, pp. 147–148.

Wharton et al., "Relativistic O–Type Oscillator–Amplifier Systems", *Intense Microwave and Particle Beams*, vol. 1226, Bellingham, Wash., 1990, p. 23.

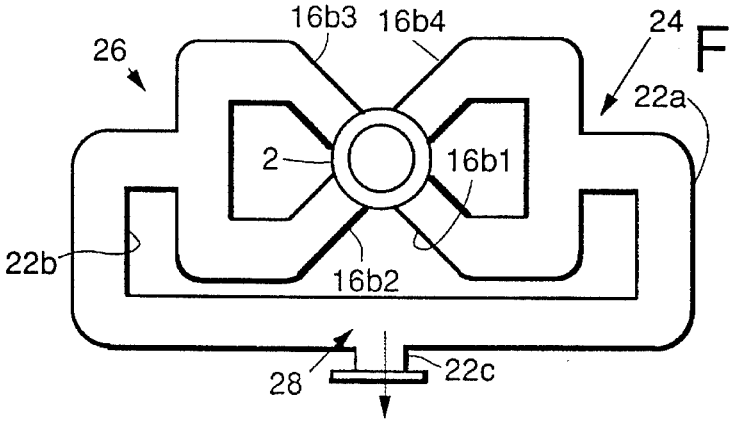
FIG. 4a.
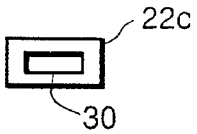
FIG. 4b.
FIG. 5.
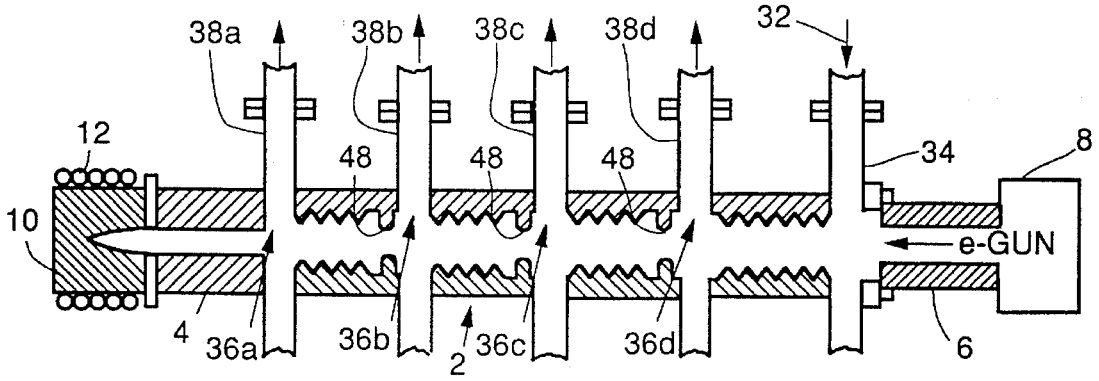
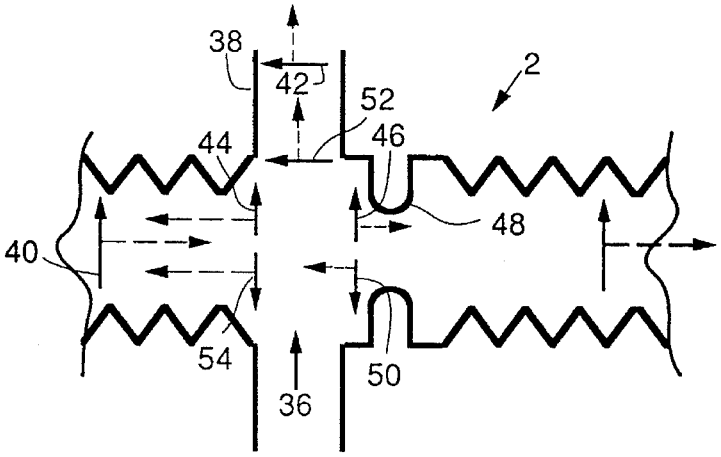
FIG. 6.

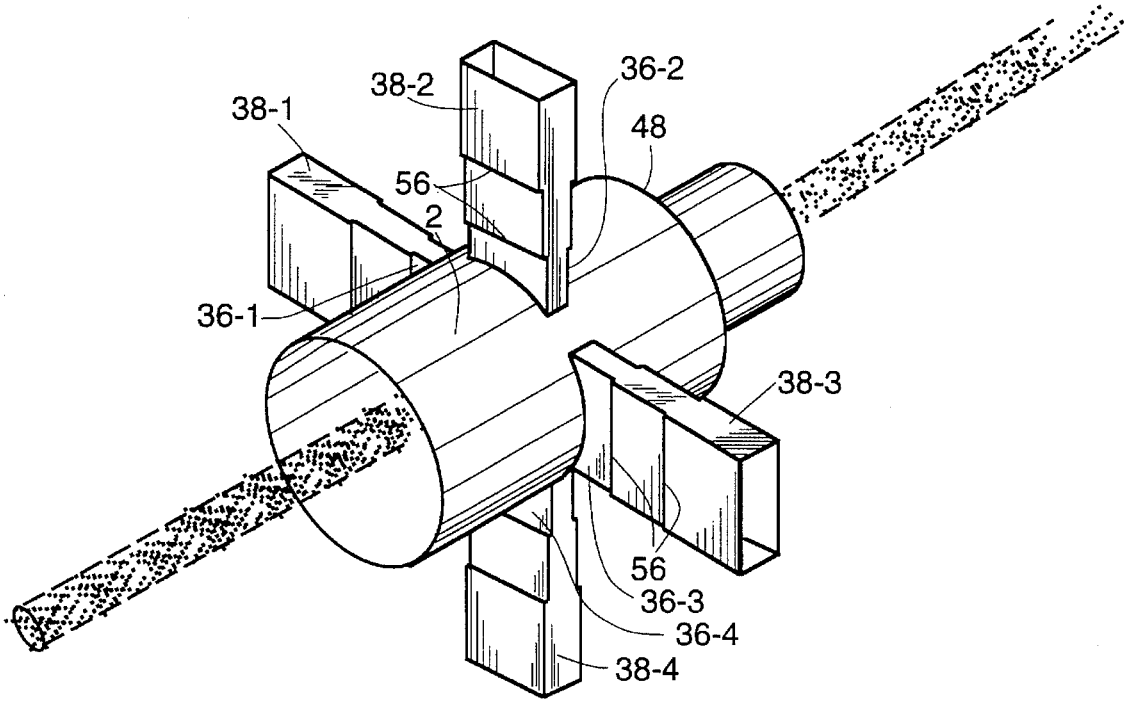
FIG. 7.
FIG. 8.
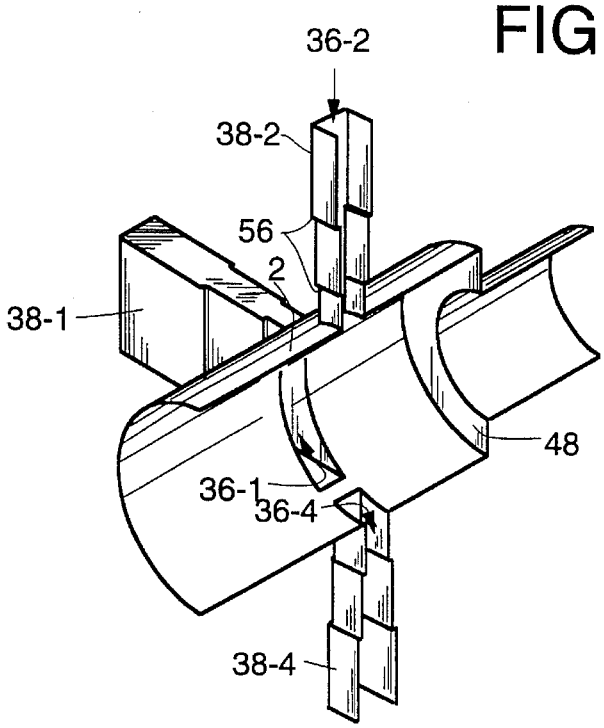

RF SOURCE INCLUDING SLOW WAVE TUBE WITH LATERAL OUTLET PORTS

BACKGROUND OF THE INVENTION

1. Field of the Invention

This invention relates to radio frequency (RF) radiation sources, and more particularly to slow wave tubes that are coupled with electron beams to provide an RF source and to related energy extraction mechanisms.

2. Description of the Related Art

High power slow wave structures commonly consist of a cylindrical waveguide with a periodically varying inner wall radius in the form of a periodic series of ripples. These structures support electromagnetic waveguide modes, with some waves having phase velocities less than the speed of light. Slow wave tubes have been coupled with electron ($e^-$) beams directed along the tube axis to generate RF power, specifically in the microwave regime ($10^9$–$10^{11}$ Hz).

Two devices of this type are generally categorized as backward wave oscillators (BWOs) and travelling wave tube amplifiers (TWTAs), and are described in J. Swegle et al., *Phys. Fluids,* 28(9), Sep. 1985, pages 2882–2894, and W. W. Destler et al., "Microwave and Particle Beam Sources and Propagation" *SPIE* Vol 873, (1988), pages 84–91. With a BWO, a spontaneous generation of microwave power occurs at a frequency that is determined by a combination of the tube geometry and the $e^-$beam current and voltage. In plasma-filled devices the frequency is also dependent on the plasma density. Instabilities occur within the tube when the e-beam's slow space charge wave has the same phase velocity as a structure mode. Under these conditions the beam's slow space charge wave can develop, resulting in the deceleration of beam electrons as beam bunching occurs. The decelerated electrons release energy which is systematically coupled into the electromagnetic wave field of the slow wave structure. These fields, which have an axial electric field component, enhance the bunching of the beam's space charge and thereby further decelerate the beam electrons, thus transferring more energy into the wave fields. As the positive reinforcement cycle continues, the structure's electromagnetic fields exponentially increase in amplitude at the frequency of the beam-structure resonance, resulting in a spontaneous generation of microwave power.

In a BWO, the coupling of the slow space charge wave with the tube's modes occurs when the structure mode has a negative group velocity. This results in a transfer of $e^-$beam energy to the electromagnetic wave field in a direction that is backward, or opposite, to the direction of the $e^-$beam. The spontaneous generation of microwave power grows out of $e^-$beam noise and the structure's internal feedback, with no input RF signal. The backward traveling RF wave is reflected off either the $e^-$beam generator itself, or off a smaller diameter section of the tube near the $e^-$beam generator which acts as a waveguide below cutoff for the operating frequency of the device as shown in FIG. 1. It then travels in a second pass through the tube for extraction at the opposite end of the tube from the $e^-$beam generator.

If the $e^-$beam's slow space charge wave couples with a tube mode that has a positive group velocity, as opposed to the negative group velocity associated with a BWO, the slow wave structure is commonly known as a TWTA. In this case the transfer of $e^-$beam energy to the wave field is forward, or co-directional, with the direction of the $e^-$beam. RF excitation from an external source must be launched into the tube near the end that receives the $e^-$beam for the signal to be grown exponentially as it propagates (in a single pass) along the length of the structure.

A simplified sectional view of a conventional structure that can function as a BWO is given in FIG. 1. An electron gun 100 transmits an $e^-$beam through an internally rippled slow wave tube 102. Functioning as a BWO, a backward traveling RF wave is reflected off the end of the (smaller diameter) unrippled tube section 104 adjacent the $e^-$gun, and emerges from the flared tube outlet 106. A structure that can function in a TWTA mode is shown in FIG. 2, in which the same reference numerals are used to indicate the same elements as in FIG. 1. An input RF signal is coupled into the side of the tube through a coupling port or ports 108 into a region which can propagate the RF signal downstream into the slow wave structure. To restrict the signal from propagating upstream and entering the $e^-$gun, the smaller diameter tube section 104 which cannot propagate the RF signal is positioned upstream of the coupling region and downstream of the $e^-$gun. In this mode the RF signal grows as it propagates forward through the tube, and is emitted without a reflection of its propagation direction.

There are several undesirable limitations of both the BWO and TWTA. Since the RF signal is extracted from the same end of the slow wave tube where the $e^-$beam is collected, special provisions must be made to extract the RF signal while terminating the $e^-$beam. In magnetized devices the beam can be propagated out of the confining magnetic field region and allowed to expand, striking the waveguide wall. In alternative approaches various types of "beam dumps" in the form of plugs at the end of the waveguide tube have been employed, but they are difficult to design so that they do not interfere with the RF signal. In both elimination methods the $e^-$beam impacting the waveguide or "dump" surface tends to result in the formation of plasma (which can adversely effect the radiation of RF power) at the end of the tube by partially reflecting, absorbing and/or scattering the RF signal.

The permissible average $e^-$beam power and energy, and thus the amount of average power that can be transferred to the RF signal, is also limited by the need to collect the $e^-$beam at the same location at which the RF signal is extracted. The use of a simple water cooling system for the beam collector would permit operation at a higher $e^-$beam duty cycle and average power. However, water cooling systems which require metal structures for effective heat transfer or re-circulating liquid coolant must be positioned in the throat of the RF radiating aperture and thus can interfere with the extraction of the RF signal. This limits the use of water cooling, with a consequent reduction in the duty cycle and average powers that might otherwise be achieved.

In the case of a BWO, the backward direction of the RF signal as it is originally generated also leads to inefficiencies. The need to reflect the backward propagating RF wave at the input end of the tube, and then allow it to travel in a second pass to the outlet end of the tube, can result in a reduction in signal amplitude through wall losses, as well as adversely affecting the structure's conversion efficiency.

The RF signal extracted from the slow wave tube is fundamentally in the $TM_{01}$ (cylindrical waveguide) mode established by the dynamics of the RF generating interaction between the electron beam's space charge wave and the cylindrical waveguide's electromagnetic field components. However, a rectangular $TE_{10}$ mode is generally preferred for radiating RF signals, since this mode can be easily managed and fed directly to antenna feeds for radiation. A separate mode converter is thus necessary to place the generated RF signal in the desired mode format for radiation.

A BWO with $TE_{10}$ extraction waveguides at the opposite end of the tube from the e-beam source is illustrated in Phelps, "More Than 10 GW from a Relativistic BWO?" *Third National Conference on High Power Microwaves Digest,* December 1986, pages 240–244 (FIG. 6). However, the extraction waveguides require the radiation to undergo two full passes through the BWO before it can be extracted, additional unwanted modes could be excited, and only individual extractions are disclosed. An article in the same publication by Voss et al., "Characterization of a High Power Microwave Cross-Field Oscillator Operated at S-Band" pages 147–148, shows a slow wave tube with a single lateral extraction structure. With this device there would be an excitation of unwanted modes over appreciable bandwidths, there is no provision for multiple phase coherent outputs that can be used for a phased array antenna, the amount of power that can be extracted is quite limited, and the system is asymmetrical. In Wharton and Butler, "Relativistic O-Type Oscillator-Amplifier Systems" *Intense Microwave and Particle Beams,* Vol. 1226, Bellingham, Wash., 1990, page 23, two TWT amplifiers are driven by a single relativistic BWO master oscillator. Microwave samples are obtained from extraction ports near the input end of a BWO and coupled into respective TWTAs. There is no disclosure of any $TM_{01}$-to-$TE_{10}$ mode conversion, the extraction will excite propagations other than ($TM_{01}$ cylindrical waveguide modes) over appreciable bandwidths, the two output samples are used independent of each other, and again the outputs are not compatible as inputs to a phased array antenna.

SUMMARY OF THE INVENTION

The present invention seeks to provide a new coupling approach to high power RF extraction from a BWO or TWTA. Three significant differences from previous approaches are proposed. 1) A side extraction technique is used at the output to avoid interference from the mechanism used to collect the $e^-$beam. 2) A specially designed 4-port coupler is utilized for this extraction to improve the RF coupling efficiency and maintain a pure mode condition within the cylindrical tube. 3) Multiple ports are used to provide a higher peak RF power through the use of multiple RF outputs that are phase coherent over the full RF pulse duration, and that can be combined to produce a steerable RF beam with a higher power than that which is attainable from a single RF output. The invention further seeks to provide for an inherent mode conversion from a $TM_{01}$ cylindrical waveguide mode to a $TE_{10}$ rectangular waveguide mode built into the RF extraction mechanism, thus eliminating the need for a separate mode converter.

These goals are achieved with the use of an $e^-$beam source, a slow wave tube that is positioned to receive an $e^-$beam from the source, a mechanism for causing RF radiation to travel through the tube, and a novel outlet port arrangement distributed along the side of the tube for extracting RF radiation therefrom. The RF radiation can either be self-generated as in a BWO, or excited from an external RF source and amplified within the tube as in a TWTA.

The slow wave tube has a periodically rippled inner surface, and the multiple outlet ports are positioned along the tube and have axial dimensions such that the phase coherence of the RF generation process is maintained. It is preferable to have the final RF power in a rectangular $TE_{10}$ waveguide mode, but the generated energy is in a circular waveguide $TM_{01}$ mode. A 4-port extraction technique solves this problem, with the extracted RF radiation from each of the ports combined into a single rectangular waveguide $TE_{10}$ mode.

Multiple outlet port regions are provided along the length of the tube to yield a plurality of phase coherent RF outputs that are useful as inputs to a phased array antenna. The multiple outlet ports also enable a distribution of the output RF signal along the length of the tube, and thus makes possible a higher total output power by reducing the risk of RF breakdown across a single port. In the TWTA application, in which the RF signal is progressively amplified during its propagation through the tube, the outlet ports are positioned at axial intervals such that the multiple RF outputs yield similar magnitudes and phase of RF power. The separation of the RF signal extraction from the end of the tube at which the $e^-$beam is terminated also permits the use of a metallic water cooling system for the $e^-$beam absorber, thus further increasing the system's average power capacity.

These and other features and advantages of the invention will be apparent to those skilled in the art from the following detailed description, taken together with the accompanying drawings.

BRIEF DESCRIPTION OF THE DRAWINGS

FIG. 4*a* is a elevation view of a balanced RF extraction structure;

FIG. 4*b* is a plan view of the final outlet of the RF extraction structure shown in FIG. 4*a;*

FIG. 5 is a simplified sectional view of a TWTA in accordance with the invention;

FIG. 6 is a diagram illustrating a left-to-right traveling wave in the vicinity of an extraction port and a reduced diameter portion of the tube;

FIG. 7 and 8 are respectively perspective and sectioned perspective views of an impedance matched RF extraction structure designed for 100% extraction (the extraction percentage can be varied depending on the geometry of the extraction coupler);

DETAILED DESCRIPTION OF THE INVENTION

Figure 3:
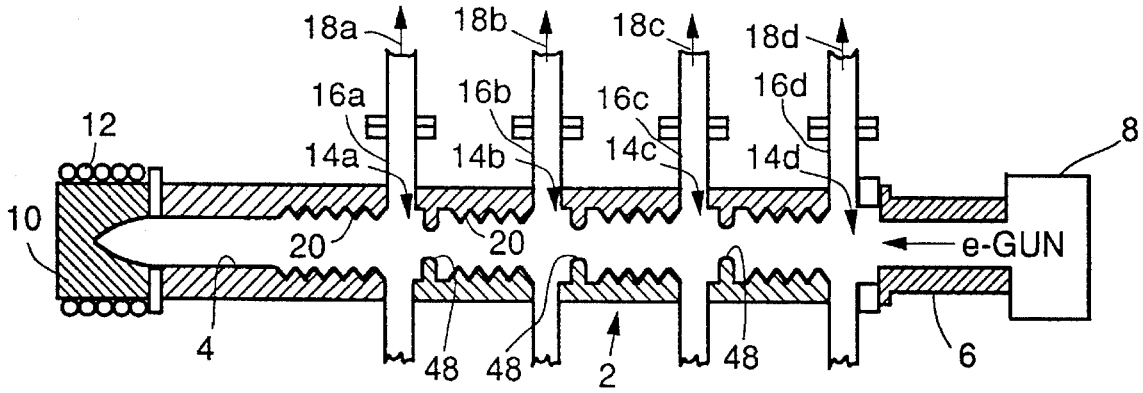
FIG. 3 is simplified sectional view of a BWO in accordance with the invention.

A BWO implementation of the invention is shown in FIG. 3. It includes a 4-sectioned slow wave tube 2, forward and rear cylindrical extensions 4 and 6 of the tube which do not propagate the RF energy, and an electron gun 8 that generates and directs an $e^-$beam through the tube via rear extension 6. The $e^-$beam exits the tube via the forward extension 4, and is absorbed by an electron-absorbent "beam dump" structure 10. The electron beam collector can be surrounded by a metallic water cooling system 12. The separation of the $e^-$beam termination from the extraction of RF power from the slow wave tube 2, as described below, permits the use of a metallic water cooling system without interfering with the RF output.

The electron gun 8 is preferably implemented as described in U.S. Pat. No. 4,912,367 to Schmuacher et al. and assigned to Hughes Aircraft Company, the assignee of the present invention. This type of device injects a high current density $e^-$beam into the waveguide established by slow wave tube 2 and extensions 4 and 6. The $e^-$beam current density is high enough to at least partially ionize the gas within the waveguide. The waveguide gas pressure is kept at a level, preferably within the approximate range of 1-to-5×$10^{-5}$ Torr, that is sufficiently low to avoid voltage breakdown in the $e^-$gun, but high enough to allow sufficient ionization to substantially neutralize space-charge blowup of the $e^-$beam. By thus restricting the diameter of the $e^-$beam, the use of externally applied magnetic fields that must ordinarily be maintained around the beam to limit it expansion is avoided.

Other types of $e^-$beam guns can also be used, but are not as preferable as the device described in U.S. Pat. No. 4,912,367. $E^-$beam guns in general are described in J. Hansen, "US TWTS from 1 to 100 GHz", *Microwave Journal:* 1989 *State of the Art Ref.* (1989), pages 179–193, and in R. B. Miller, *Introduction to the Physics of Intense Charged Particle Beams,* Plenum Press, New York, 1985, pages 31–76.

A novel aspect of the structure shown in FIG. 3 is that RF radiation is extracted through a series of lateral tube extraction sections 14*a*, 14*b*, 14*c* and 14*d*, rather than from the end of the waveguide in the vicinity of the beam dump 10. The extraction ports, illustrated as ports 14*a*, 14*b* and 14*c*, are located in the side of slow wave tube 2; an additional extraction port 14*d* is located at the upstream waveguide end of the tube 2.

The extraction ports 14*a*–14*d* couple into respective extraction waveguides 16*a*, 16*b*, 16*c*, 16*d* which guide the RF signals away from the tube. In the BWO mode the backward directed RF radiation all along the length of the tube is phase coherent (in-phase) and at a substantially uniform power level. The RF outputs 18*a*, 18*b*, 18*c* and 18*d* from respective waveguides 16*a*, 16*b*, 16*c* and 16*d* are accordingly all in phase with each other, and can therefore be directly applied to a phased array antenna.

The amount of RF power extracted through each of the output ports 14*a*–14*d* can be varied according to the coupler design. Thus, by distributing the RF output among a plurality of ports as illustrated, a greater total RF power output can be achieved without breakdown than would be the case if only a single extraction port were used.

The TWT and extraction ports are preferably configured to maintain phase coherency in the RF wave from one extraction port to the next. The RF wavelength is a function of the tube dimensions, the extraction port configuration and the periodicity of ripples 20, and is different at the extraction ports from its dimension in the tube sections between ports.

The extraction ports are preferably distributed along the full length of the slow wave tube, and thus extract most or all of the generated RF power that is directed rearward. Since this power is extracted during the first pass through the tube, before reflection from the $e^-$gun 8 or from a diameter reduction in the tube extension 6, an added degree of efficiency over the prior double-pass BWO is achieved. The reverse power level is fairly uniform along the length of the tube, with its absolute value dependent mainly upon the amount of time the system has been in operation. The ports can therefore be located at any desired locations along the tube, but the spacing between ports should be maintained as described above. Greatest efficiency is achieved when one of the ports (18) is located proximate to the end of the tube nearest the $e^-$gun, and thus assures that substantially all of the RF energy is extracted before reflection. The fact that the average RF signal path length through the tube is shorter when a number of separate extraction ports are employed, resulting in a lower level of losses at the interior tube walls, provides a further enhancement to operational efficiency.

The extraction ports 14*a*–14*d* and extraction waveguides 16*a*–16*d* preferably have rectangular interior openings to couple the $TM_{01}$ cylindrical waveguide mode to the $TE_{10}$ rectangular waveguide mode for the extracted RF power. The extraction waveguides should be impedance matched with the slow wave tube to avoid RF reflections back into the tube. However, the provision of only a single lateral extraction port at each extraction location along the tube can lead to the excitation of other circular waveguide modes in the tube because of the asymmetries involved. An extraction structure that avoids this problem is illustrated in FIGS. 4*a* and 4*b*. Rather than a single extraction guide such as 16*b* at a given location along the slow wave tube, four extraction ports and corresponding extraction waveguides 16*b*1, 16*b*2, 16*b*3 and 16*b*4 are provided at 90° intervals around the circumference of the slow wave tube 2. The RF signals in guides 16*b*1 and 16*b*4 are combined into a single guide 22*a* via an H-plane T-connection 24, while the RF signals in waveguides 16*b*2 and 16*b*3 are combined into a single RF signal in another waveguide 22*b* by a second H-plane T-connection 26. Finally, the RF signals in waveguides 22*a* and 22*b* are combined in a single final RF output waveguide 22*c* by a third H-plane T-connection 28. Numerous other designs for combining the extracted signals can be used, such as E-plane T-connections, hybrid couplers, or individual waveguide-to-coaxial adaptors that run from the extraction waveguides to a 4-way coaxial combiner. The waveguides would preferably be shaped to present a considerably smaller profile than the demonstration apparatus shown in FIG. 4*a*.

Each of the waveguides employed in the extraction process at a given coupling location has a similar rectangular interior opening, such as interior opening 30 for the final waveguide 22*c* illustrated in FIG. 4*b;* the dimensions of the rectangular opening are selected to support the $TE_{10}$ rectangular mode over a frequency range determined by the operation of the slow wave tube structure and optimized for the coupling from the $TM_{01}$ cylindrical mode to the four rectangular $TE_{10}$ arms. An effective mode conversion from the $TM_{01}$ mode within the slow wave tube to the $TE_{10}$ in an external waveguide is thus achieved.

The application of the invention to a TWTA is illustrated in FIG. 5, with elements common to FIG. 3 indicated by the same reference numerals. In this application, externally generated microwave radiation 32 is coupled into the end of the slow wave tube 2 in front of the extension tube 6, via a coupling waveguide 34, which preferably has the same 4-port circumferential arrangement as the RF extraction structure in FIG. 4*a*. This initiates a single pass transmission of RF radiation from the end of the slow wave tube adjacent the extension tube 6 to the opposite end of the slow wave tube adjacent the $e^-$beam collector 10, with the RF radiation undergoing progressive amplification during its transit. A series of RF extraction ports 36*a*, 36*b*, 36*c*, 36*d* and associated extraction waveguides 38*a*, 38*b*, 38*c*, 38*d* are positioned along the length of the tube in a manner similar to extraction ports 14*a*–14*d* and waveguides 16*a*–16*d* of FIG. 3.

Figure 1:
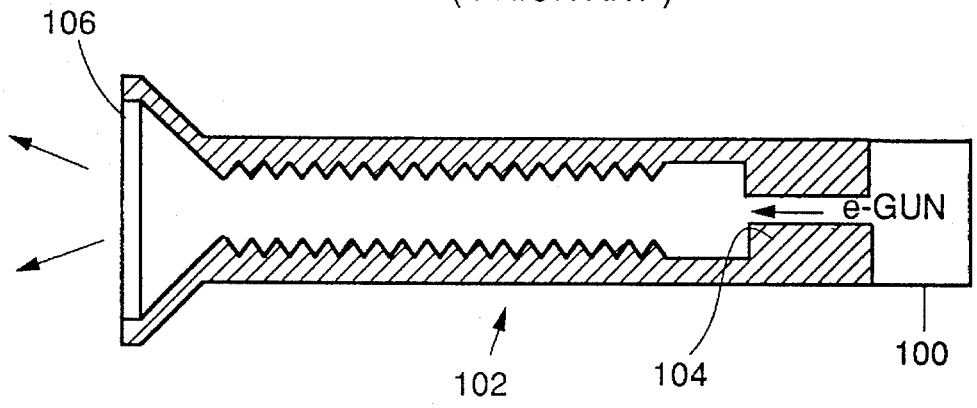
FIG. 1. ( PRIOR ART )
FIG. 1 is a simplified sectional view of a known BWO.
Figure 2:
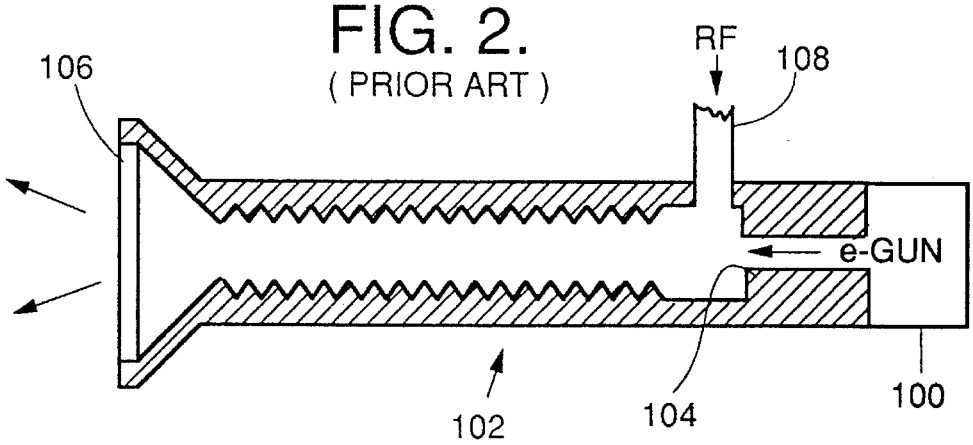
FIG. 2. ( PRIOR ART )
FIG. 2 is a simplified sectional view of a known TWTA.

The high power RF outputs from either the BWO of FIG. 3 or the TWTA of FIG. 5 are phase coherent over the full RF pulse duration, and frequency tunable by adjustment of the $e^-$beam voltage and current. The multiple outputs can be directly fed through electronically controlled phase shifters to radiating elements to produce a steerable RF beam, without the prior need for splitting a single RF source into multiple coherent sources. The prior distortion of the RF output beam obtained with the structure of FIG. 1, which was associated with its proximity to the $e^-$beam collection, is avoided, and a water cooled beam collector can be used. Higher power levels are achievable through both the spatial distribution of the output RF signal, and the enhanced $e^-$beam absorption capability.

As described thus far, energy can be lost from the system by scattering from the outlet ports. The invention effectively cancels the effects of back-scattering through the tube, while at the same time reinforcing the extraction of radiation in a $TE_{10}$ mode, using a principle of operation illustrated in the diagram of FIG. 6. The RF radiation of a wave propagating from left-to-right through the slow wave tube 2 immediately prior to an outlet port 36 is represented by arrow 40, with the arrow's head indicating the phase of the radiation. At the port, some of the RF energy is coupled out in a $TE_{10}$ mode through the rectangular waveguide 38 (arrow 42), some of the energy is scattered from the outlet port including a back scattered component (arrow 44), and the remainder is transmitted along the tube past the outlet port (arrow 46). In each case, the direction of propagation is indicated by the dashed line arrow that extends orthogonally from the radiation arrow. The back-scattered component 44 corresponds to an energy loss that would be desirable to eliminate.

A more energy efficient operation is achieved by reducing the diameter of the RF guiding structure downstream from the outlet ports 36*a*–36*d* to reflect back a portion of the transmitted radiation, with the reflection characteristics controlled so that the back-scattered radiation 44 is cancelled. The diameter reduction 48 is spaced from the outlet port by approximately an integral number of radiation half-wavelengths for this purpose. The proportion of the radiation that is reflected will depend upon the relative diameters of the tube prior to and after the diameter reduction 48. Assuming the diameter reduction is located an odd number of half-wavelengths from the outlet port, the radiation will undergo a 180° phase shift during transit from the outlet port to the diameter reduction, and another 180° phase shift during the reverse transit. However, an additional 180° phase shift is also imposed upon the reflected radiation at the point of reflection, so that the reflected wave 50 will be 180° out-of-phase with the transmitted wave.

A portion of the reflected radiation 50 is coupled out through the rectangular waveguide 38 (arrow 52), in-phase with the forward-directed extracted radiation 42, while the remainder (arrow 54) continues past the outlet port 180° out-of-phase with the back-scattered radiation 44. The reflected radiation 52 that is coupled out through the outlet waveguide 38 will thus constructively add to the extracted radiation 42 already present, while the reflected radiation 54 that continues back past the outlet port will destructively add to the back scattered radiation 44. With an appropriate selection for the dimension of extraction waveguide 38 and the relative amount of tube diameter reduction 48, the reflected radiation 54 that continues back through the tube can effectively cancel the back scattered radiation 44, while the sum of the extracted radiation components 42 and 52 can be fixed at a desired extraction percentage of the total radiation initially propagating along the tube. A lower limit to the tube diameter after reduction is set by the need to provide enough open area for the $e^-$beam to continue past the diameter reduction.

FIGS. 7 and 8 show a demonstration of this type of operation in which essentially 100% of the continuous waveguide energy through a cylindrical tube 2 was coupled out through a set of four rectangular extraction waveguides 38-1, 38-2, 38-3, 38-4, spaced at 90° intervals around a circumference of the tube 2. To accomplish this, the diameter reduction 48 (see FIG. 8) was sufficient to totally cut off propagation of the $TM_{01}$ mode, causing the energy that was transmitted past the extraction waveguides to be totally reflected back through the tube. The dimensions of the extraction ports 36-1, 36-2, 36-3, 36-4 as generally shown in FIG. 7 for the rectangular waveguides were selected so that the back-scattered radiation was effectively cancelled by the reflected radiation that continued back past the extraction ports. For any particular system, the sizes of the extraction ports can be determined empirically or by computer modelling; in the specific demonstration illustrated in the drawings the tube diameter was 3.5 cm, the extraction ports were 0.8 cm long in the direction of the tube axis, and the tube's diameter after the reduction 48 was 2.0 cm. Since the desired dimension for the extraction waveguide 38 was not a standard size, the extraction waveguides were stepped up to standard dimensions via a series of steps 56 that were spaced one-quarter wavelength apart from each other to avoid reflections.

Figure 9:
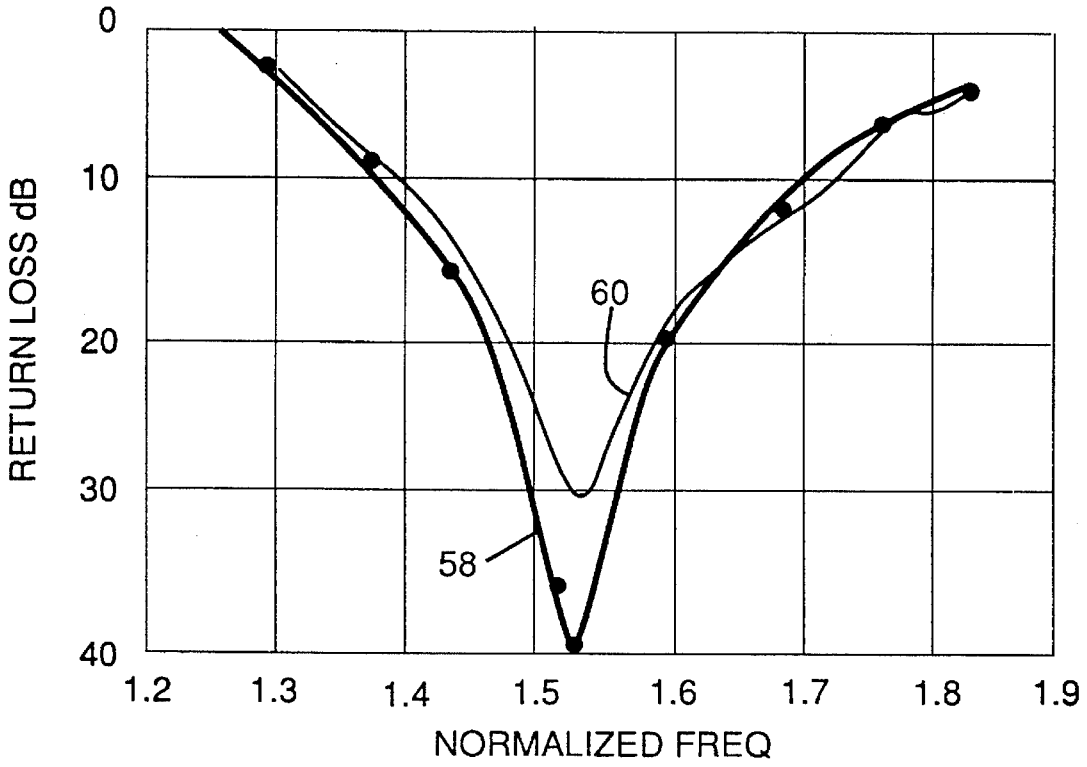
FIG. 9 is a graph of the theoretical and measured return losses from the RF extraction structure as a function of normalized frequency.

FIG. 9 is a graph showing the theoretical computer modelled and actual results achieved with the 100% extraction demonstration. The horizontal axis represents the signal frequency, normalized to a $TM_{01}$ cutoff frequency of 1.0, while the vertical axis indicates the non-extracted energy at each frequency that was returned back through the tube; the "return loss" vertical axis scale is a measure of the returned radiation at each frequency compared to the energy of the radiation initially transmitted at that frequency. The tube and extraction waveguides were tuned to a normalized frequency of 1.54, but other frequencies over a wide bandwidth could have been selected. Curve 58 shows the projected results from computer modelling, while curve 60 shows the actual results. With a return loss of about 30 dB at the tuned normalized frequency of 1.54, a very high level of efficiency was demonstrated.

Figure 10:
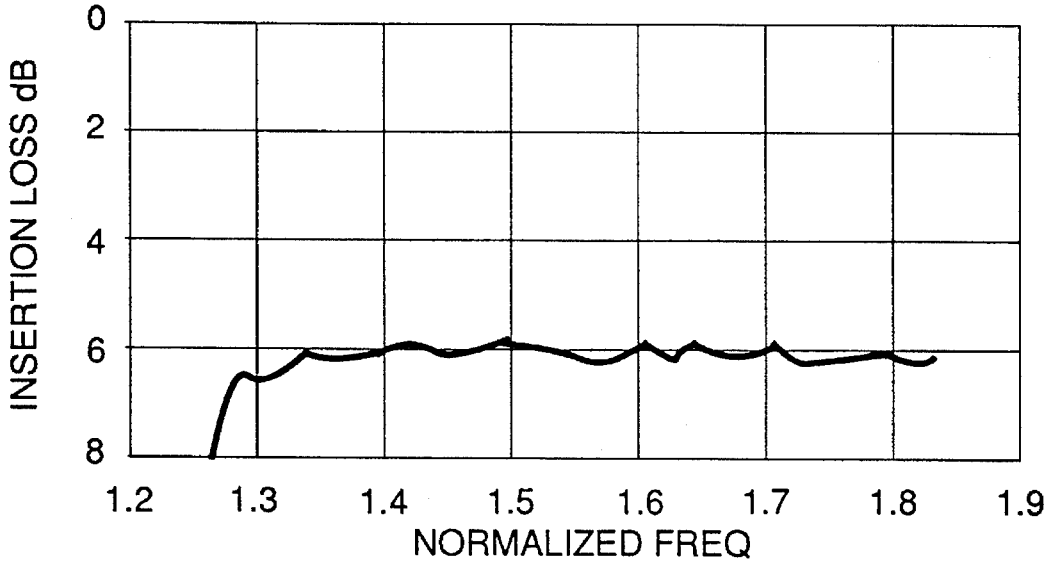
FIG. 10 is a graph of the insertion loss to one of the extraction ports as a function of normalized frequency.

A balance in the energy extracted through the four rectangular waveguides at each extraction site is provided by their circular symmetry. Ideally, each extraction port would couple one-quarter of the desired output level. FIG. 10 shows the coupling that was measured for one of the extraction waveguides; the theoretical best would be a flat 6 dB line, corresponding to 25% of the input energy. In FIG. 10 the extracted energy begins to decline rapidly at a normalized frequency just below 1.3. This corresponds to the results shown in FIG. 9, in which a return loss of about 3 dB (corresponding to 50 % transmission and 50 % reflection) was observed at a normalized frequency just below 1.3.

Figure 11:
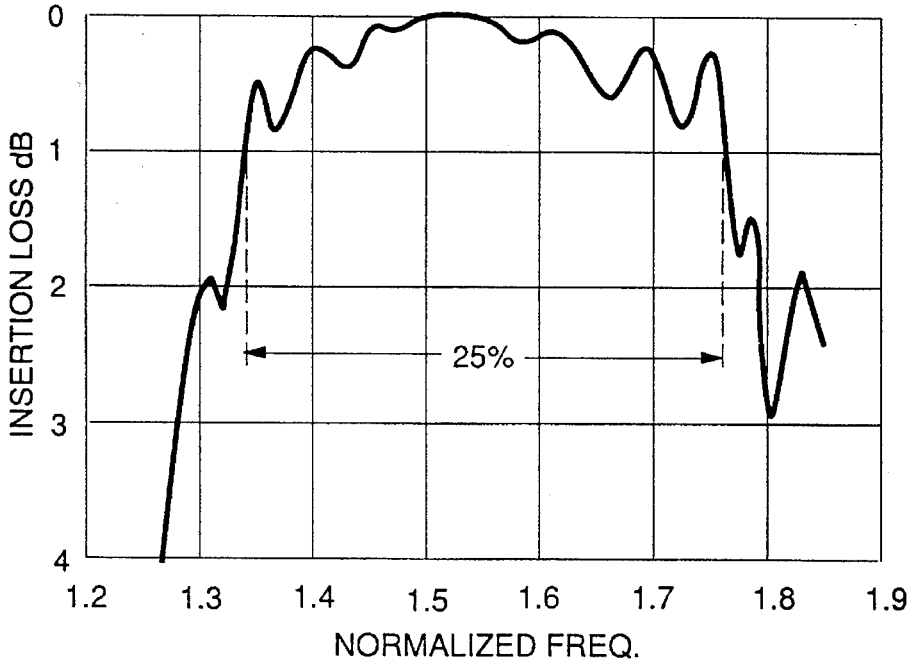
FIG. 11 is a graph of the overall insertion loss for the $TM_{01}$ cylindrical waveguide mode to $TE_{10}$ rectangular waveguide mode converter, again as a function of normalized frequency.

Measurements were also made of the insertion loss for the total mode converter illustrated in FIG. 4*a*, comparing the $TE_{10}$ rectangular waveguide output to the $TM_{01}$ cylindrical waveguide input. The results are shown in FIG. 11. An insertion loss of essentially 0 dB was observed at the normalized 1.54 tuned frequency, while a bandwidth of approximately 25% was obtained between the 1 dB insertion loss points above and below the tuned frequency. This represents a very wide and satisfactory bandwidth over which effective operation can take place.

Figure 12:
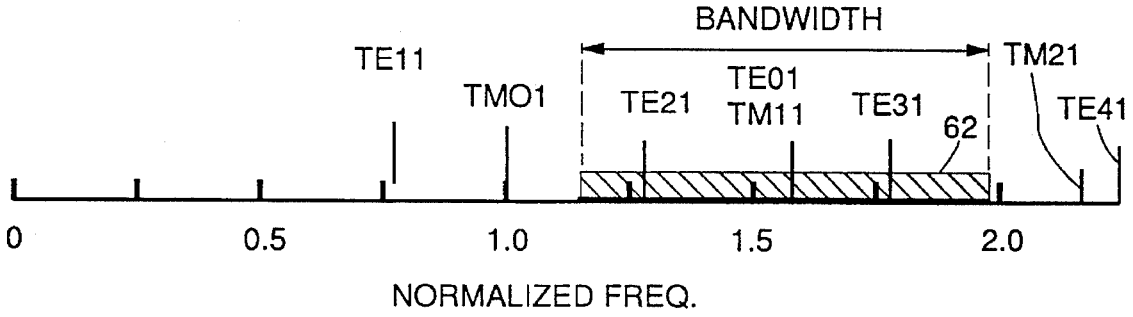
FIG. 12 is a mode propagation diagram for an operating band of interest.

It is important to avoid the excitation of any modes other than the $TE_{10}$ mode, since additional mode excitations add to the system's energy losses and degrade its bandwidth. The manner in which the present invention achieves a wide bandwidth without exciting unwanted modes is illustrated in FIG. 12. The cutoff frequencies for various possible propagation modes below which the mode will not propagate (for an infinite length waveguide) are indicated, with the $TM_{01}$ mode having a normalized frequency of 1.0; the cutoff frequencies vary inversely with the tube diameter. A desired bandwidth is indicated by the hatched area 62. While numerous different propagation modes could theoretically be excited within this bandwidth, none of them are excited by the 4-port extraction system of the present invention, in which four extraction ports are spaced at 90° intervals around the circumference of the slow wave tube at each extraction site. For example, the $TE_{11}$ mode would be excited by 1-port extraction system, and the $TE_{21}$ mode would be excited by a 2-port extraction system. The next mode above the desired $TM_{01}$ that would be excited by the invention's 4-port extraction system is the $TE_{41}$ mode. However, the normalized cutoff frequency for this mode is about 2.25, which is considerably above the upper end of the desired band.

While theoretically the bandwidth could extend all the way from the 1.0 $TM_{01}$ cutoff point up to the edge of the $TE_{41}$ cutoff frequency, for practical systems in which the circular waveguide is of limited length a safety margin should be left above the $TM_{01}$ and below the $TE_{41}$ cutoff frequencies. This is because, in approaching the $TM_{01}$ cutoff from a higher frequency level, a dispersion effect accompanied by very large variations in the waveguide impedance are encountered. Also, in approaching the $TE_{41}$ cutoff from a lower frequency level, $TE_{41}$ propagations are encountered that decay with waveguide length but can still be significant at frequencies below the nominal cutoff frequency for limited length waveguides. Accordingly, band edge margins on the order of 20–25% both above the $TM_{01}$ and below the $TE_{41}$ cutoff frequencies would normally be expected and acceptable.

While several illustrative embodiments of the invention have been shown and described, numerous variations and alternate embodiments will occur to those skilled in the art. Such variations and alternate embodiments are contemplated, and can be made without departing from the spirit and scope of the invention as defined in the appended claims.

We claim:

1. A radio frequency (RF) source, comprising:

a tube with an interior opening for receiving an electron beam, at least a portion of said tube comprising a slow wave portion, an electron beam source positioned with respect to said tube, which generates and directs said electron beam in a predetermined direction through said tube, means responsive to said electron beam being directed through said tube for causing RF energy to travel through said tube, and a plurality of outlet ports distributed along said tube for extracting the RF energy therefrom with at least one of said outlet ports configured to extract substantially less than the full RF energy at a location thereof along the tube.

2. The structure of claim 1, wherein at least some of said outlet ports are positioned along the slow wave portion of said tube.

3. The structure of claim 2, the slow wave portion of said tube having a periodically rippled inner surface, wherein said outlet ports are distributed along a length of the slow wave portion of said tube with spacings between successive ports equal to a substantially integral number of ripple periods.

4. The structure of claim 1, wherein the slow wave portion of said tube is cylindrical and configured to propagate the RF energy in a $TM_{01}$ mode, and said outlet ports are rectangular and configured to extract the RF energy therefrom in a $TE_{10}$ rectangular mode.

5. The structure of claim 4, wherein at each outlet port location along the tube, a set of four similar waveguide pods is provided at substantially 90° intervals around a tube circumference.

6. The structure of claim 1, wherein said electron beam source and tube defines a backward wave oscillator which generates RF energy in the slow wave portion of said tube and in which the electron beam interacts with the RF energy of the slow wave portion of said tube to cause the RF energy to travel through the tube, said outlet ports being positioned to extract the RF energy from said tube during a single pass of said energy through the tube in a direction of extraction which is opposite to the predetermined direction of propagation of said electron beam, without substantial reflection of said energy in a reverse direction through the tube.

7. The structure of claim 1, wherein said electron beam source is located at one end of the tube, said means for causing the RF energy to travel through the tube comprising an inlet port to the tube for admitting the externally generated RF energy into the tube at a location toward the electron beam source end of the tube, said outlet ports being positioned along the tube on a side thereof opposite to said inlet port location from said electron beam source.

8. A radio frequency (RF) source, comprising:

a tube with an interior opening for receiving an electron beam, at least a portion of said tube comprising a slow wave portion, an electron beam source positioned with respect to said tube, which generates and directs said electron beam in a predetermined direction through said tube, means responsive to said electron beam being directed through said tube for causing RF energy to travel through said tube, and a plurality of outlet ports distributed along said tube for extracting the RF energy therefrom, with a set of four similar waveguide ports at substantially 90° intervals around a tube circumference at each outlet port location along the tube, and respective rectangular waveguides opening into said tube at each of said waveguide ports, having respective dimensions which are suitable for extracting up to 100% of the RF energy propagating through the tube, and said tube has a reduced diameter at a plurality of locations, each of the locations being offset from a respective set of waveguide ports to reflect some of the RF energy transmitted past the respective set of waveguide ports back through the tube.

9. The structure of claim 8, further comprising means for combining the RF radiation extracted through the rectangular waveguides at each outlet port location to respective single $TE_{10}$ rectangular mode propagations.

10. The structure of claim 8, wherein the location of each reduction in the diameter of said tube is spaced from the respective set of waveguide ports so as to reflect the RF energy back through the tube approximately 180° out of phase with respect to the energy scattered back from the respective set of waveguide ports.

11. The structure of claim 10, wherein the amount of reduction in the diameter of said tube and the dimensions of said rectangular waveguides cause the RF energy reflected back through the tube past the respective set of waveguide pods for each diameter reduction to approximately cancel the energy scattered back through the tube from said respective set of waveguide ports.

12. A radio frequency (RF) source, comprising:

a tube with an interior opening for receiving an electron beam, at least a portion of said tube comprising a slow wave portion, an electron beam source positioned with respect to said tube, which generates and directs said electron beam in a predetermined direction through said tube from one end of the tube, means responsive to said electron beam being directed through said tube for causing RF energy to travel through said tube, a plurality of outlet ports distributed along said tube for extracting the RF energy therefrom with at least one of said outlet ports configured to extract substantially less than the full RF energy at a location thereof along the tube, and means, located at an end opposite to said one end of said tube from said electron beam source, for absorbing said electron beam, and an at least partially metallic cooling means in cooling contact with said means for absorbing said electron beam.

13. Apparatus for extracting radio frequency (RF) enemy in a rectangular $TE_{10}$ mode from a cylindrical waveguide having dimensions which support the propagation of RF energy in a cylindrical $TM_{01}$ mode, comprising:

four rectangular waveguides opening into said cylindrical waveguide in a symmetrical pattern around a circumference of said cylindrical waveguide to extract the RF energy therefrom in a rectangular $TE_{10}$ mode, and means operatively connected to said four rectangular waveguides for combining the RF energy extracted by said four rectangular waveguides into a single $TE_{10}$ output, said cylindrical waveguide defining a slow wave tube.

14. A slow wave structure with a lateral extraction mechanism for radio frequency (RF) energy traveling therethrough, comprising:

a tube having an enclosing wall with a periodically rippled inner surface, a plurality of RF outlet pods extending through said wall and spaced from each other along the tube by substantially integral numbers of ripple periods, and at least one rectangular waveguide, opening into said tube at each of said outlet ports, having respective dimensions which are suitable for extracting less than all of the RF energy propagating through the tube, and said tube has a diameter which is reduced at a plurality of locations each offset from respective said at least one rectangular waveguide, opening into said tube at each of said outlet pods, to reflect some of the RF energy transmitted past the respective said at least one rectangular waveguide, back through the tube.

15. The structure of claim 14, wherein each one of said plurality of locations of reduction in the tube diameter is spaced from the respective said at least one rectangular waveguide so as to reflect the RF energy back through the tube approximately 180° out of phase with respect to the energy scattered back from the respective said at least one rectangular waveguide.

16. The structure of claim 15, wherein the amount of reduction in the tube's diameter and the dimensions of the respective at least one rectangular waveguide cause the RF energy reflected back through the tube past the respective at least one rectangular waveguide to approximately cancel the energy scattered back through the tube from the respective outlet port.

17. Apparatus for extracting radio-frequency (RF) energy in a rectangular $TE_{10}$ mode from a cylindrical waveguide having dimensions which support the propagation of RF energy in a cylindrical $TM_{01}$ mode, comprising:

four rectangular waveguides opening into said cylindrical waveguide in a symmetrical pattern around a circumference of said cylindrical waveguide to extract the RF radiation therefrom in a rectangular $TE_{10}$ mode, and means operatively connected to said four rectangular waveguides for combining the RF energy extracted by said four rectangular waveguides into a single $TE_{10}$ output, wherein said four rectangular waveguides have cross-sectional dimensions that cause less than all of the RF energy propagating through the cylindrical waveguide to be extracted, and said cylindrical waveguide has a diameter which is reduced at locations offset from said rectangular waveguides to reflect at least some of the RF energy that was not extracted through the rectangular waveguides back through the cylindrical waveguide.

18. The apparatus of claim 17, wherein said reduction in the diameter of the cylindrical waveguide is spaced from said four rectangular waveguides so as to reflect the RF energy back through the cylindrical waveguide approximately 180° out of phase with respect to the energy scattered back from the openings of said four rectangular waveguides into the cylindrical waveguide.

19. The apparatus of claim 18, wherein the amount of reduction in the cylindrical waveguide's diameter and the dimensions of the rectangular waveguide openings into the cylindrical waveguide cause the RF energy reflected back from the diameter reduction past said four rectangular waveguide openings to approximately cancel the energy scattered back from said four rectangular waveguide openings.

20. A method of converting from a cylindrical $TM_{01}$ to a rectangular $TE_{10}$ radio frequency (RF) propagation mode, comprising:

propagating RF energy in a $TM_{01}$ mode in a predetermined direction through a cylindrical waveguide, extracting the RF energy from said cylindrical waveguide in a $TE_{10}$ mode through four rectangular wave,ides that are located around a circumference of said cylindrical waveguide in mutual symmetry, wherein less than all of the RF energy propagating through the cylindrical waveguide is extracted through said rectangular waveguides, operating said $TM_{01}$ mode propagation over a bandwidth at which the cylindrical waveguide can support multiple propagation modes, but said different propagation modes are not excited by said four rectangular extraction waveguides, and reflecting at least some of the RF energy that continues past the rectangular waveguides back through the cylindrical waveguide.

21. The method of claim 20, further comprising the step of combining the RF energy extracted through each of said rectangular waveguides into a single $TE_{10}$ output.

22. The method of claim 20, wherein said reflecting step is performed at a distance downstream from the rectangular waveguides in said predetermined direction so that the reflected RF energy is approximately 180° out of phase with respect to the energy scattered back through the cylindrical waveguide from the rectangular waveguides.

23. The method of claim 22, wherein said reflecting step comprises reflecting and propagating back past said four rectangular waveguides, a portion of said RF energy having a magnitude that approximately equals and therefore approximately/cancels the energy scattered back through the cylindrical waveguide from said four rectangular waveguides.

* * * * *